United States Patent [19]

Maloney et al.

[11] 4,392,505

[45] Jul. 12, 1983

[54] COIN PAYOUT ASSEMBLY

[75] Inventors: Robert T. Maloney, Creve Coeur; Carl L. Vogt, St. Louis, both of Mo.

[73] Assignee: Coin Acceptors, Inc., St. Louis, Mo.

[21] Appl. No.: 212,273

[22] Filed: Dec. 3, 1980

[51] Int. Cl.[3] ..... G07D 9/04

[52] U.S. Cl. ..... 133/4 A; 221/265

[58] Field of Search ..... 133/2, 4 R, 4 A, 5 R; 194/10; 221/265

[56] References Cited

U.S. PATENT DOCUMENTS 4,010,765 3/1977 Clay ..... 133/4 A 4,266,563 5/1981 Fujita ..... 133/4 A

*Primary Examiner*—Stanley H. Tollberg

*Attorney, Agent, or Firm*—Cohn, Powell & Hind

[57] ABSTRACT

A coin payout assembly in which a plurality of actuating arms are operatively connected to a plurality of coin-handling members that are movable to a first position for receiving a coin and to a second position for discharging the coin, and in which a drive mechanism is selectively connected to any one of a plurality of actuating arms by a coin-selecting mechanism for moving the selected actuating arm and its associated coin-handling member. A plurality of guide slots each receive the guide pin of one of the actuating arms. The drive mechanism includes a drive link selectively alignable with any one of the actuating arms by the coin-selecting mechanism whereby the drive link is moved into engagement with the selected actuating arm for moving the associated coin-handling member.

11 Claims, 9 Drawing Figures

COIN PAYOUT ASSEMBLY

BACKGROUND OF THE INVENTION

This invention relates generally to a coin payout assembly, and more particularly to an improved coin payout assembly in which a plurality of coin-handling members are selectively actuated for discharging coins of different denominations.

In heretofore conventional coin payout assemblies, a number of solenoids were used to discharge coins of different denominations. For example, a separate solenoid was used with its own connecting assembly to discharge each different coin denomination.

SUMMARY OF THE INVENTION

The present coin payout assembly uses a single solenoid acting through a coin-selecting mechanism for operatively and selectively connecting any one of a plurality of coin-handling members to a coin-actuating assembly for discharging coins of different denominations, the coin-actuating mechanism being operated by a single motor. Moreover, this coin payout assembly enables the use of a reasonable short-stroke solenoid, and achieves a relatively small compact unit.

In one aspect of the invention, the present coin payout assembly includes a coin-selecting means operatively and selectively connected to a coin-actuating means and to each of a plurality of coin-handling means. A drive means operatively connected to the coin-selecting means is selectively connected to the coin-actuating means for moving each coin-handling means to a first position for receiving a coin and to a second position for discharging the coin.

In another aspect of the invention, the coin-actuating means includes a plurality of actuating arms each of which is operatively connected to one of the coin-handling means, and a guide means for engaging and guiding each of the actuating arms. The drive means selectively engages each of the actuating arms for moving the arm and the associated coin-handling means.

In another aspect of the invention, the guide means includes a plurality of guide slots, each of which receives a guide pin of one of the actuating arms. Selectively connectible with any one of the actuating arms by the coin-selecting means, is a drive link. This drive link and the selectively connectible actuating arm is moved for moving the associated coin-handling means.

In another aspect of the invention, the coin-selecting means includes a crosshead mounted for movement in a predetermined path, the crosshead having a first track receiving the guide pins as the crosshead moves in the predetermined path, and a second track transverse to and communicating with the first track receiving the drive link. The coin-selecting means further includes a coin-positioning means for locating the crosshead in selected position in the predetermined path for aligning the second track with any one of the guide pins and the guide slot for the selected guide pin for movement of the guide pin in the aligned guide slot by the drive link from the first track, to move the associated arm and coin-handling means.

In another aspect of the invention, the coin-positioning means includes a cam means operatively connected to the crosshead, and a solenoid operatively connected to the cam means for moving the crosshead upon energization of the solenoid.

In another aspect of the invention, a locating pin on the drive link and carried by the second track of the crosshead selectively connects the drive link with any one of the actuating arms as the second track is aligned with any of the guide slots. The drive link engages the actuating arm that has its guide pin in the aligned guide slot for moving the associated coin-handling means to one of its positions. A shoulder on the drive link engages the same actuating arm for moving the associated coin-handling means to the other of its positions.

In still another aspect of the invention, the locating pin on the drive link is received in the second track of the crosshead, and a pivot means rotatively and slidably mounts the drive link for both rotative and translational movement of the drive link as the crosshead is movably positioned and as the drive link engages the actuating arm having its guide pin in the aligned guide slot for moving the associated coin-handling means.

DESCRIPTION OF THE PREFERRED EMBODIMENT

Figure 3:
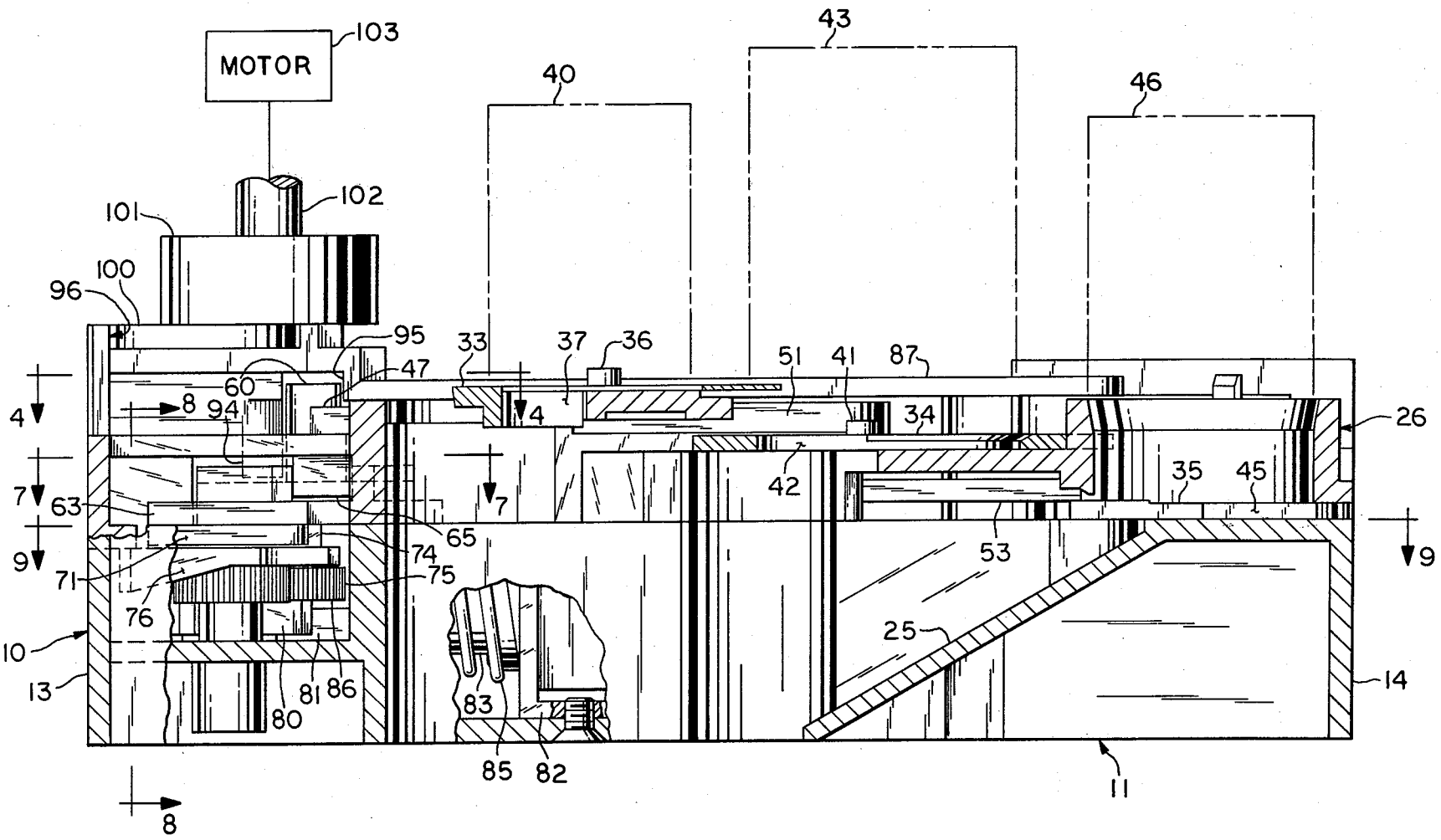
FIG. 3 is a cross-sectional view of the assembly as taken on staggered line 3—3 of FIG. 1, and illustrates the drive motor schematically and illustrates the coin storage tubes in phantom lines.
Figure 5:
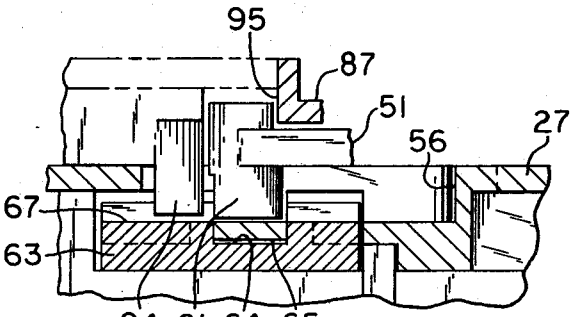
FIG. 5 is a fragmentary, cross-sectional view taken on line 5—5 of FIG. 4.
Figure 6:
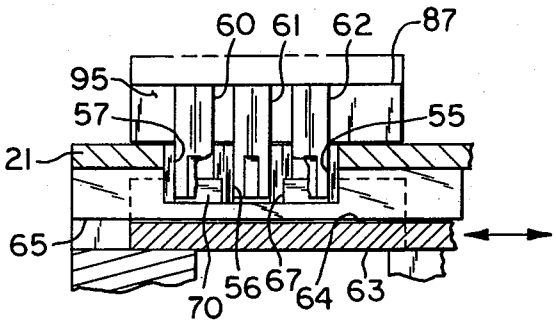
FIG. 6 is a fragmentary, cross-sectional view taken on line 6—6 of FIG. 4.
Figure 4:
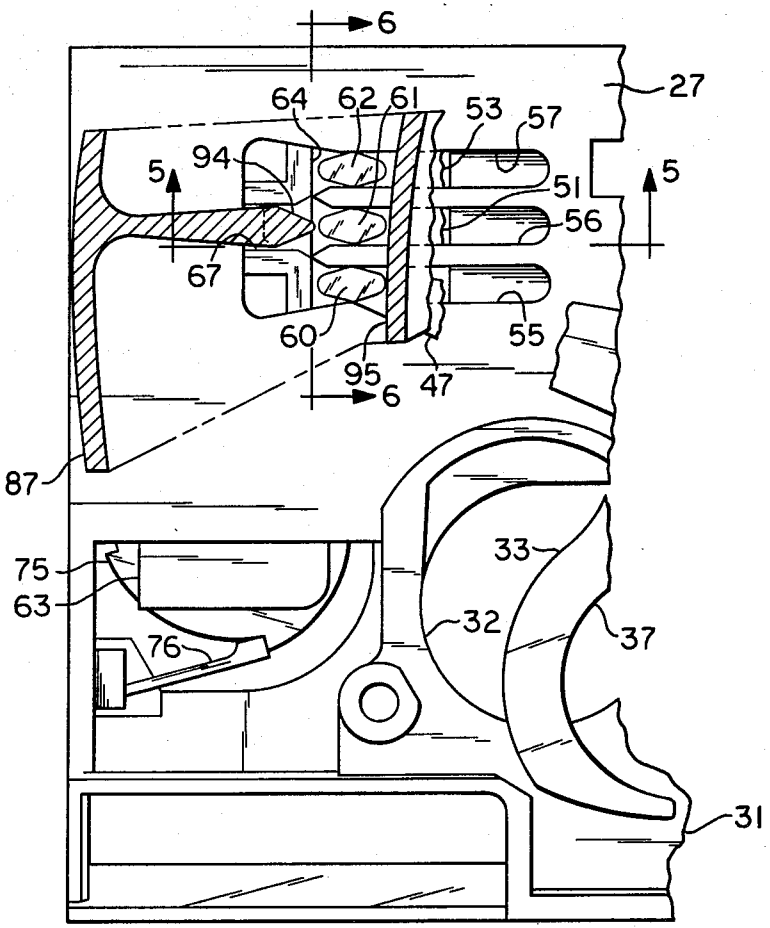
FIG. 4 is a cross-sectional view taken on line 4—4 of FIG. 3.
Figure 8:
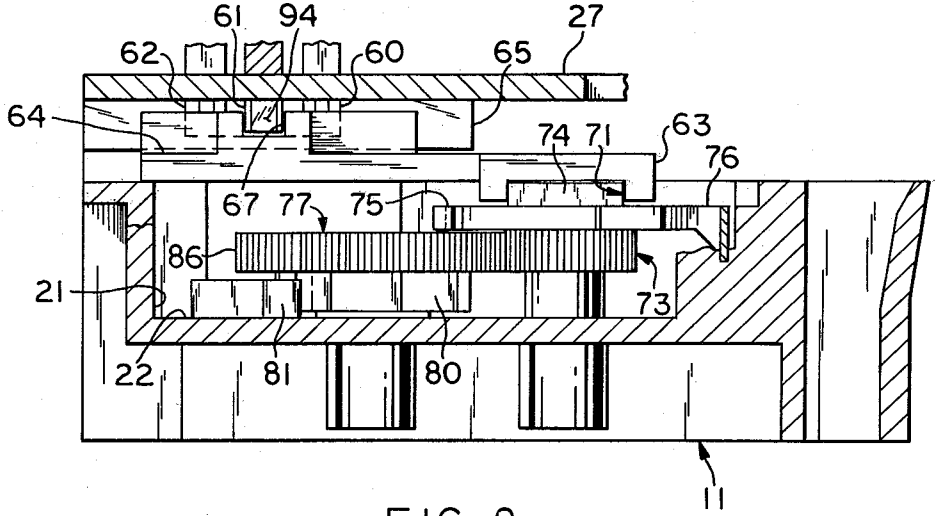
FIG. 8 is a fragmentary, cross-sectional view taken on line 8—8 of FIG. 3.
Figure 9:
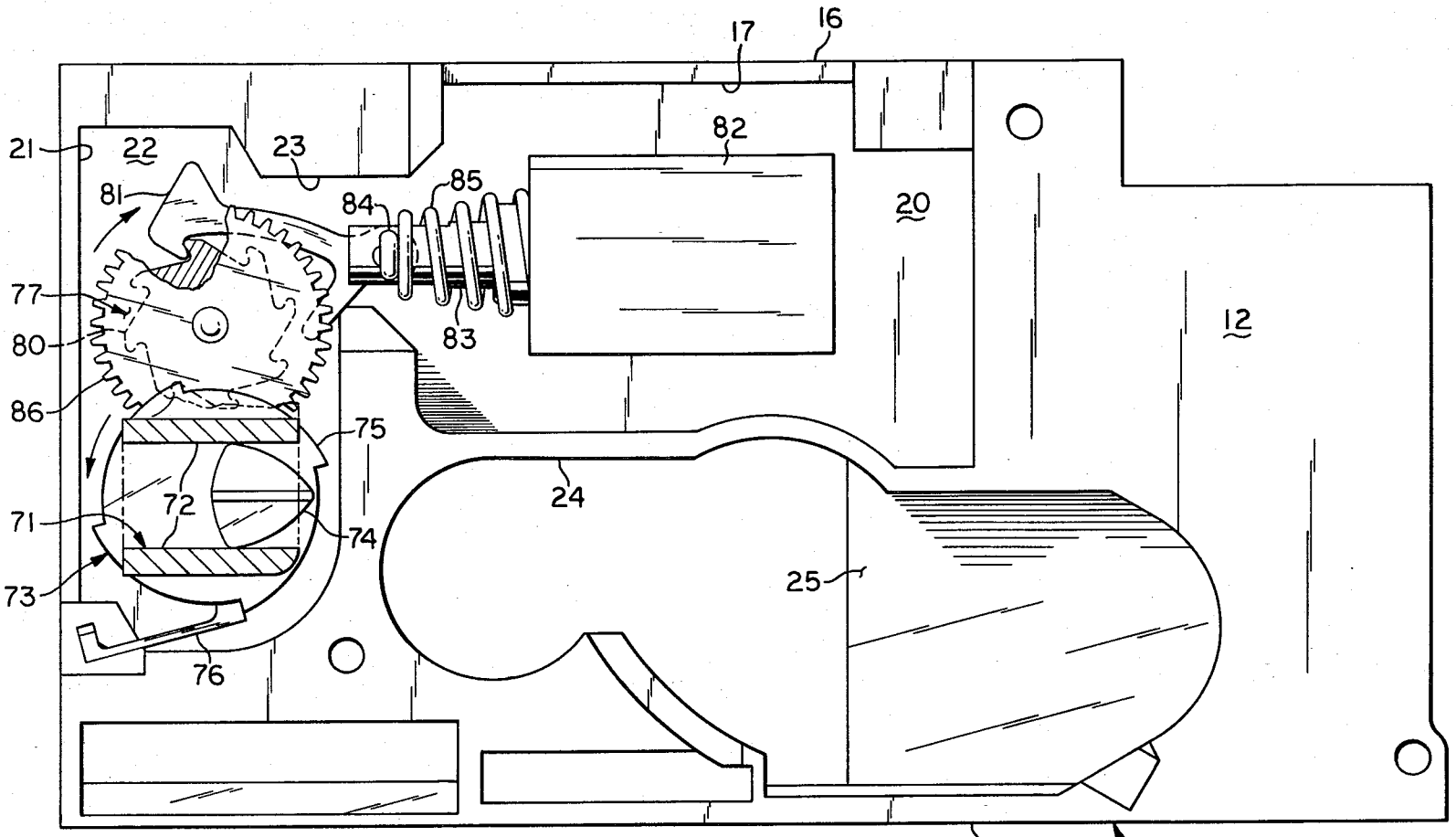
FIG. 9 is a top plan view, partly in cross section, taken on line 9—9 of FIG. 3.

Referring now by characters of reference to the drawings and first to FIGS. 3 and 9, it will be understood that the base generally indicated by 10 includes a lower base portion referred to by 11 having a top wall 12, opposed sidewalls 13 and 14, and opposed front and rear walls 15 and 16. For reasons which will later appear, the lower base portion 11 is provided with a top-opening cavity 17 in the top wall 12, the cavity 17 being partially bounded by rear wall 16 and its own bottom wall 20. Another top-opening cavity 21 is provided in the top wall 12 which is partially bounded by the side wall 13 and its own bottom wall 22. The cavities 17 and 21 are interconnected by a passageway 23. An opening 24 is provided through the top wall 12 which communicates with a coin discharge chute (not shown) adapted to return coins discharged by this assembly to the customer. This discharge opening 24 is bounded at one end by an inclined ramp 25 that merges with the top wall 12.

The base 10 further includes an upper base portion 26 that sits on and is secured to the lower base portion 11. This upper base portion 26 includes a substantially horizontal wall 27. Provided in the horizontal wall 27 is a wall opening 30 that is aligned with a portion of the discharge opening 24 formed in top wall 12 of the lower base portion 11. The horizontal wall 27 is provided with a relatively raised wall portion 31. Another opening 32 is provided in this raised wall portion 31, the opening 32 being aligned with a portion of the subjacent openings 30 and 24.

A plurality of coin-handling members 33, 34 and 35, consituting coin-handling means, are provided for receiving and discharging coins of different denominations. The coin-handling member 33 is pivoted by pivot pin 36 to the raised wall portion 31, and includes an arcuate recess 37 adapted to receive a particular coin denomination, as for example a dime shown in phantom lines in FIG. 1 and designated by the reference D. The coin-handling member 33 is pivotally movable to a first position for receiving a coin D from a coin storage tube 40 indicated in phantom lines in FIG. 3. In this first position of coin-handling member 33, the coin D received in the recess 37 is supported on the raised wall portion 31. The coin-handling member 33 is pivotally movable to a second position in which the recess 37 is aligned directly over the wall opening 32 for allowing the coin D, carried by the member 33 in the recess 37, to fall through the aligned openings 30 and 24 for discharge from the assembly.

The similar coin-handling member 34 is pivotally mounted to the horizontal wall 27 by pivot pin 41. This coin-handling member 34 is provided with an arcuate recess 42 for receiving a particular denomination of coin, as for example a quarter as shown in phantom lines and designated by reference Q in FIG. 1. The coin-handling member 34 is movable to a first position shown in FIG. 1 in which the recess 42 receives the coin Q from a coin storage tube 43 illustrated by phantom lines in FIG. 23. In this first position of coin-handling member 34, the coin Q is supported on the horizontal wall 27. The coin-handling member 34 is selectively movable to a second position illustrated in FIG. 2 in which the recess 42 is aligned directly over and with the wall openings 30 and 24, allowing the coin Q to fall through the openings 30 and 24 for discharge.

The coin-handling member 35 is pivotally mounted by pivot pin 44 to the underside of the horizontal wall 27. This coin-handling member 35 is provided with an arcuate recess 45 for receiving and holding a coin of a particular denomination, as for example a nickel illustrated by broken lines and designated by reference N. In a first position of the coin-handling member 35, the recess 45 receives a coin N from a coin storage tube 46 shown in phantom lines in FIG. 3. In this first position of the coin-handling member 35, the coin N is supported on the top wall 12. When the coin-handling member 35 is pivotally moved to a second position, the coin N located in the recess 45 and carried by the coin-handling member 35 is located over the opening 24 so that the coin N falls down the ramp 25 and through the opening 24 for discharge.

A coin-actuating means is operatively connected to each coin-handling member 33–35. Specifically, the coin-actuating means includes an actuating arm 47 having one end pivotally connected by pivot pin 50 to the coin-handling member 33, an actuating arm 51 having one end pivotally mounted by pivot pin 52 to the coin-handling member 34, and an actuating arm 53 having one end pivotally connected by pivot pin 54 to the coin-handling member 35.

The coin-actuating means further includes a guide means for receiving and guiding each of the actuating arms 47, 51 and 53. More particularly, this guide means includes a plurality of guide slots 55, 56 and 57. Each of the other ends of the actuating arms 47, 51 and 53 is provided with a guide pin 60, 61 and 62 respectively. These guide pins 60–62 are slidably located and movable in the guide slots 55–57 respectively.

A coin-selecting means is operatively and selectively connected to the coin-actuating means and consequently to each of the coin-handling members 33–35. This coin-selecting means includes a crosshead 63 mounted for reciprocative and slidable movement in a predetermined path. More particularly, the cross-head 63 is provided with a first track 64 that receives the guide pins 60–62 as the crosshead 63 moves in the predetermined path. A guide bar 65 depending from the horizontal wall 27 is slidably mounted in the first track 64 for mounting the cross-head 63 and constraining the movement of the crosshead 63 to its predetermined path. A recess 66 formed in the guide bar 65 receives the guide pins 60–62 while the guide pins are located in the first track 64. In addition, the bar recess 66 communicates with the open ends of the guide slots 55–57.

The crosshead 63 further includes a second track 67 disposed transversely to and on opposite sides of the first track 64 and communicating with the first track 64. The second track 67 is of a width to receive only one of the guide pins 60–62, and is selectively alignable with only one of the guide slots 55–57 at a time as the crosshead 63 is moved in its predetermined path.

Figure 7:
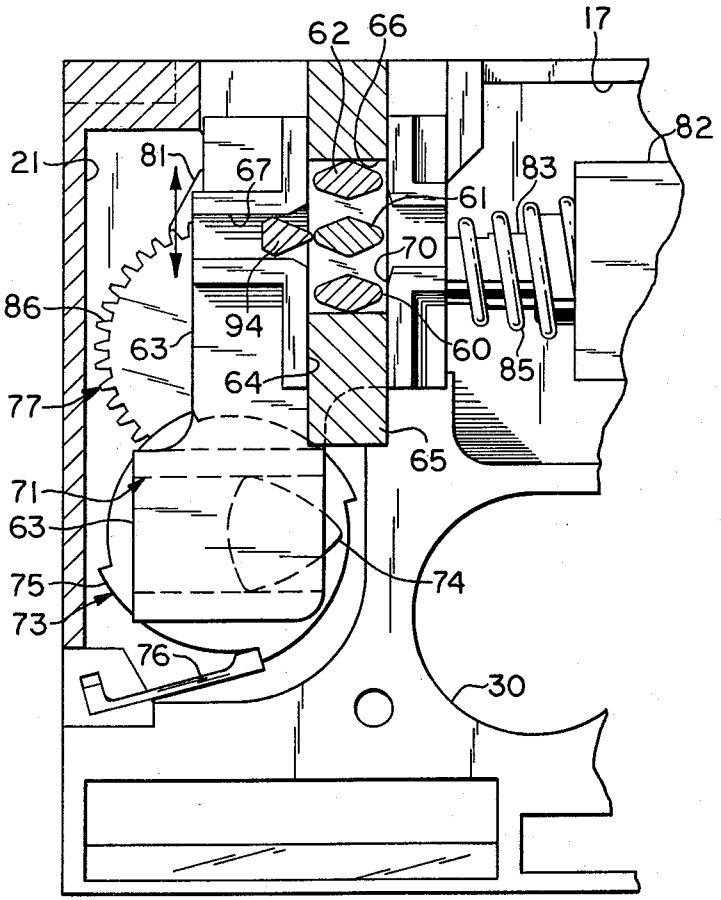
FIG. 7 is a fragmentary, cross-sectional view taken on line 7—7 of FIG. 3.

As shown in FIG. 7, the first track provides stops 70 adjacent opposite sides of the second track 67 for engaging and precluding movement of the guide pins 60–62 in the guide slots 55–57 except for that guide pin located in the guide slot aligned with the second track 67.

Further, the coin-selecting means includes a crosshead-positioning means for selectively locating the second track 67 in alignment with a selected guide pin and guide slot. This crosshead-positioning means includes a cam follower 71 formed on the bottom of the crosshead 63, and specifically provided by a pair of spaced flanges 72, as shown in FIG. 9.

Located in and rotatively mounted on the bottom wall 22 of cavity 21, is a first wheel 73. A cam 74 is eccentrically carried by the first wheel 73 and operatively engages the spaced flanges 72 constituting the cam follower 71 for moving the crosshead 63 upon rotation of the first wheel 73. A ratchet 75 formed on and carried by the first wheel 73 operatively engages a resilient pawl 76 for assuring rotation of the first wheel 73 in one direction only and for retaining the first wheel 73 and its cam 74 in predetermined positions for accurately locating and positioning the crosshead 63 in selected predetermined positions.

A second wheel 77 is located in and rotatively mounted on the bottom wall 22 of cavity 21. Formed on and rotatable with the second wheel 77 is a ratchet 80. Operatively engaging and rotating the ratchet 80, is a pawl 81.

Located in and fixedly mounted to the bottom wall 20 of cavity 17 is a solenoid 82. The solenoid 82 is operatively connected to the second wheel 77 for rotating the second wheel 77 upon energization of the solenoid. Particularly, the solenoid 82 includes a plunger 83 that is pivotally connected to the pawl 81 by a cotter pin 84, constituting a pivot pin. The plunger 83 and the pawl 82 extend through the passageway 23. A compression spring 85 mounted on and about the plunger 83 tends to urge the plunger 83 in an extended position upon de-energization of the solenoid 82, while energization of the solenoid 82 urges the plunger 83 to a retracted position, thereby causing the pawl 81 to rotate the second wheel 77 by its engagement with the ratchet 80.

Gearing 86 formed on the first and second wheels 73 and 77 drivingly and operatively interconnects the first and second wheels 73 and 77 for determining the rotated position of the cam 74 and hence the selected position of the crosshead 63.

A drive means is operatively connected to the coin-selecting means and is selectively connected to the coin-actuating means for moving each coin-handling member 33–35 to the first and second positions previously described. The drive means includes a drive link 87 having one end 90 rotatively and slidably mounted for enabling both rotative and translational movement of the drive link 87. This mounting includes a pivot pin 91 on the link and 90 that is located for rotative and sliding movement in an elongate pivot and guide slot 92 formed in boss 93 on the horizontal wall 27.

The drive link 87 also includes a depending, locating pin 94 disposed in and carried by the second track 67 of crosshead 63. The locating pin 94 effectively and selectively connects the drive link 87 with any one of the actuating arms 47, 51 and 53 as the second track 67 is selectively aligned with any one of the guide slots 55–57. As the drive link 87 is moved by the crosshead 63, the drive link 87 rotatively moves about the pivot pin 91. Then, the drive link 87 engages the selected actuating arm 47, 51 or 53 having its guide pin 60–62 respectively in the aligned guide slot 55–57 respectively for moving the associated coin-handling member 33–35 respectively to one of its positions. Specifically, the locating pin 94 of the drive link 87 engages the guide pin 60–62 of the selected actuating arm 47, 51 or 53 respectively to move the guide pin from the first track 64 and into the respective guide slots 55–57. The selected actuating arm 47, 51 or 53 then rotates the associated coin-handling member 33–35 from its first position to its second position. During this driving action by the drive link 87, the pivot pin 91 will slide in the elongate slot 92.

Formed on the drive link 87 is a shoulder 95 that engages the selected actuating arm 47, 51 or 53, and more particularly the guide pin 60–62 of the selected actuating arm 47, 51 or 53, for moving the guide pin 60–62 along its guide slot 55–57 and into the first crosshead track 64, and thereby moving the associated coin-handling member 33–35 back to its first position. During this return movement of the drive link 87, the pivot pin 91 slidably moves back along and in the elongate slot 92.

Figure 1:
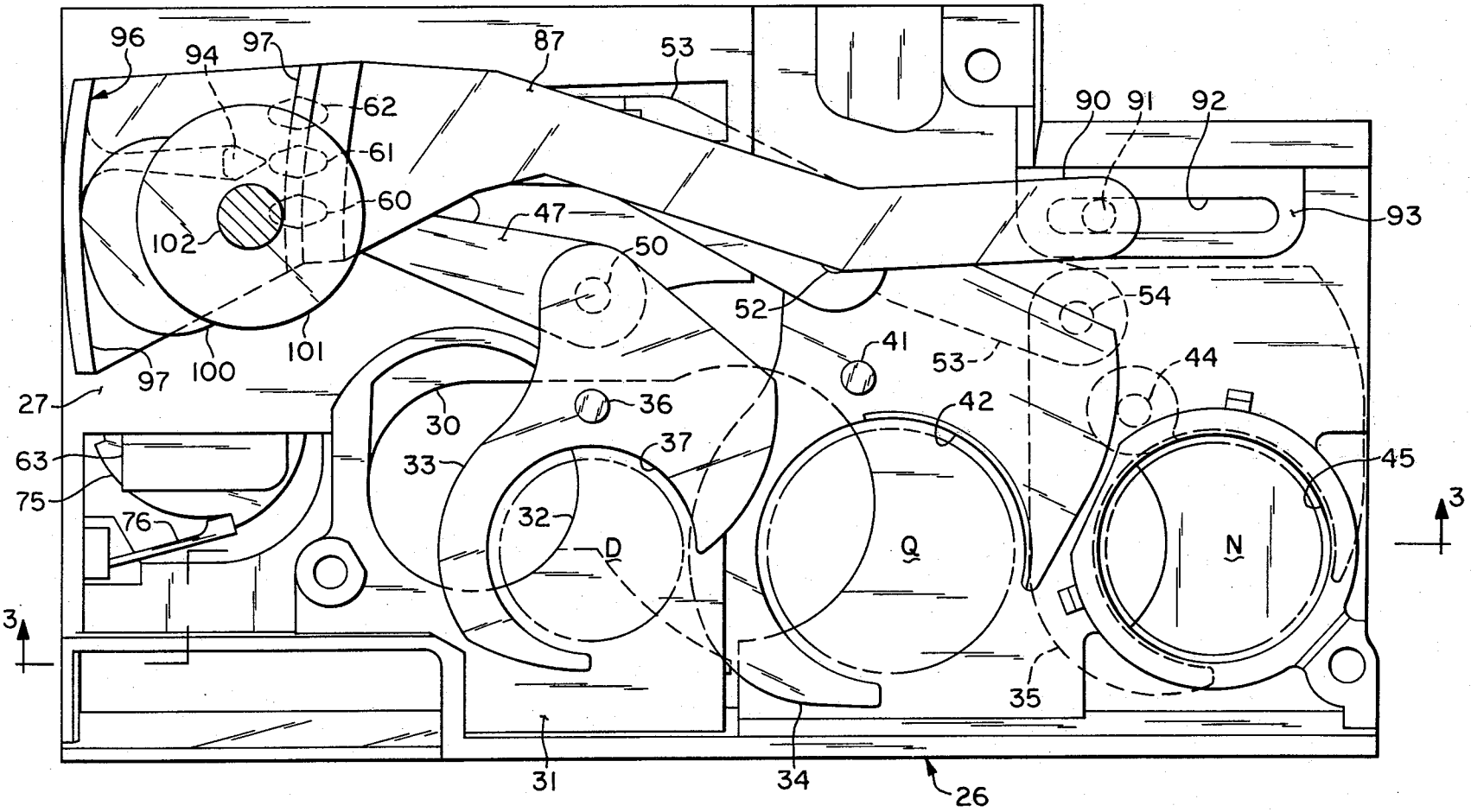
FIG. 1 is a top plan view of the coin payout assembly.
Figure 2:
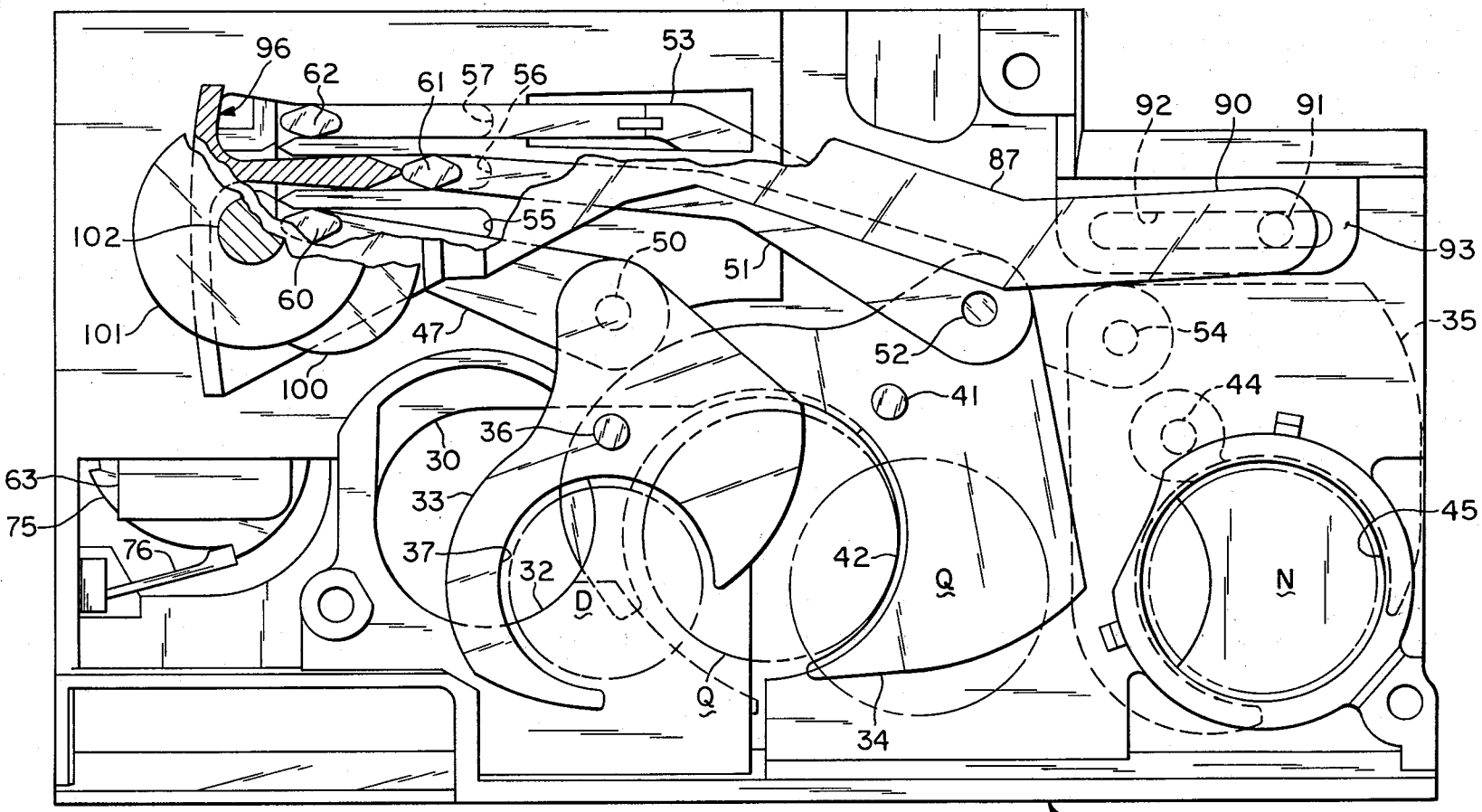
FIG. 2 is a top plan view of the assembly, similar to FIG. 1, but showing the drive link partially cut away and moved to illustrate the movement of a selected actuating arm and coin-handling member.

The drive means further includes a cam follower 96 on the upper side of the drive link 87, the cam follower 96 being provided by a pair of spaced arcuate upturned flanges 97, shown in FIG. 1. Operatively engaging the spaced flanges 97 of the cam follower 96, is a cam 100 integrally formed with wheel 101 that is drivingly attached to a drive shaft 102, the cam 100 being eccentrically mounted with respect to the axis of the drive shaft 102. The drive shaft 102 is operatively connected for rotation to a motor 103 as is schematically illustrated in FIG. 3. Upon energization of the motor 103, the cam 100 is rotated about the axis of shaft 102 and engages the flanges 97 of the cam follower 96 to move the drive link 87 reciprocatively incident to dispensing coins.

It was thought that the functional advantages of the payout assembly have become apparent from the foregoing detailed description of parts, but for completeness of disclosure the operation of this assembly in dispensing coins will be briefly described. It will be understood that before operation of this payout assembly, the coin-handling members 33–35 are located in first positions with their respective recesses 37, 42 and 45 located below the coin storage tubes 40, 43 and 46 to receive and hold coins D, Q and N respectively. In the first position of the coin-handling members 33–35, the buide pins 60–62 of the actuating arms 47, 51 and 53 respectively are located in the first track 64 of crosshead 63. The locating pin 94 of the drive link 87 is located in the second track 67 with the cam 100 positioning the drive link 87 at one limit of its movement, as is shown in FIG. 1.

If it is desired to dispense a coin Q (a quarter), the solenoid 82 is energized and de-energized sufficiently so that the interacting ratchet 80 and pawl 81 turns the second wheel 77 and the first wheel 73 through gearing 86 to locate the cam 74 in the position illustrated in FIG. 9. In this position, the cam 74 engaging the cam follower 71 locates the crosshead 63 in the position shown in FIG. 7 in which the second track 67, and the locating pin 94 dispose in the second track 67, are aligned with the guide pin 61 of actuating arm 51. Also, the second track 67 is aligned with the end opening of guide slot 56.

Then, the motor 103 is energized to rotate the drive shaft 102 and the cam 100 about the axis of drive shaft 102. The cam 100 engages the upturned flanges 97 of cam follower 96 to move the drive link 87 from the position illustrated in FIG. 1 to the position illustrated in FIG. 2. During this driving movement of drive link 87, the locating pin 94 engages the guide pin 61 and moves the guide pin 61 out of the first track 64 and into the second track 67 and along its compatible guide slot 56. The associated actuating arm 51 rotates the coin-handling member 34 from the first position shown in FIG. 1 to its second position shown in FIG. 2 in which the coin Q is released and falls through the openings 30 and 24 for discharge. Upon further rotation of the drive shaft 102 by the motor 103, the cam 100 engaging the cam follower 96 moves the drive link 87 back to its original position shown in FIG. 1. During this return movement of drive link 87, the link shoulder 95 engages the guide pin 61 of actuating arm 51 to urge the guide pin 61 back along the guide slot 57 and into the first track 64 of the crosshead 63. The actuating arm 51 rotates the coin-handling member 34 from its second position shown in FIG. 2 to its first position illustrated in FIG. 1 so that the recess 42 will receive and retain another coin Q fed from the coin storage tube 43.

In order to dispense a coin D, as for example a dime, the solenoid 82 is energized and de-energized so as to rotate the second wheel 77 by the coacting ratchet 80 and pawl 81. The coacting gearing 86 then rotates the first wheel 73 sufficiently to rotate the cam 74 to a position so that the cooperating cam 74 and cam follower 71 moves the crosshead 63 to a predetermined position whereby the second track 67 is aligned with the guide pin 60 and its compatible guide slot 55. In this selected predetermined position of crosshead 63, the motor 103 is energized so that the coacting cam 100 and cam follower 96 moves the drive link 87 toward the right of FIG. 1 as permitted by the movement of pin 91 in the pin slot 92. As the drive link 87 is moved, the drive link 87 acting through the locating pin 94, engages and urges the guide pin 60 out of the first track 64 and into the second track 67, the guide pin 60 moving into its compatible guide slot 55. The actuating arm 47 having the guide pin 60, is moved so as to rotate the coin-handling member 33 from its first position shown in FIG. 2 to a second position in which the recess 37 is aligned directly over the openings 30 and 24 so that the coin D carried by the coin-handling member 33 will be released from the recess 37 and fall through the openings 30 and 24 for discharge.

As the drive shaft 102 completes its full rotation of 360° (three hundred and sixty degrees), the cam 100 engaging the cam follower 96 will move the drive link 87 back to its initial position shown in FIG. 1. During this return movement of drive link 87, the link shoulder 95 engages the guide pin 60 of actuating arm 47 to urge the guide pin 60 along its guide slot 55 and back into the second track 67, and thence into the first track 64. Moreover, during this return movement of actuating arm 47, the coin-handling member 33 will be pivotally rotated back to its first position as shown in FIG. 1 so that the recess 37 will receive and retain another coin D from the coin storage tube 40.

In order to dispense a coin N such as a nickel, the solenoid 82 is energized and de-energized to rotate the second wheel 77 by coacting ratchet 80 and pawl 81 sufficiently so that the first wheel 73 is rotated by interconnecting gearing 86 to position the cam 74 in a selected position so that the coacting cam 74 and cam follower 71 will selectively move the crosshead 63 to a position in which the locating pin 94 and the second track 67 are aligned with the guide pin 62 of actuating arm 51 and with the guide slot 57. Then, upon actuation of the motor 103, the drive shaft 102 will rotate the cam 100 so that the coacting cam 100 and cam follower 96 will urge the drive link 87 to the right when viewed in FIG. 1 as permitted by the sliding movement of pivot pin 91 in the guide slot 92. During this driving movement of the drive link 87, the locating pin 94 engages the guide pin 62 to move the guide pin 62 from the first track 64 and into the second track 67, and along the guide slot 57, and the associated actuating arm 53 pivots the coin-handling member 35 from its first position shown in FIG. 1 to its second position in which the recess 45 is located above and aligned with the opening 24 and ramp 25. In this second position of the coin-handling member 35, the coin N is released from the recess 45 and falls down the ramp 25 and through the opening 24 for discharge.

Upon continued rotation of the cam 100 by motor 103 back to its original position shown in FIG. 1, the drive link 87 is urged toward the left of FIG. 1 back to its original position as permitted by the sliding movement of pivot pin 91 in guide slot 92. During this return movement of the drive link 87, the link shoulder 95 engages and moves the guide pin 62 of actuating arm 53 back along its guide slot 57 and into the second track 67, and thence into the first track 64 of the crosshead 63. During this return movement of actuating arm 53, the arm 53 pivotally rotates the coin-actuating member 35 back from its second position to its first position illustrated in FIG. 1 so that the recess 45 will then receive and retain another coin N delivered from the coin storage tube 46.

We claim as our invention:

1. A coin payout assembly, comprising:

(a) a plurality of coin-handling means, each coin-handling means being movable to a first position for receiving a coin and to a second position for discharging the coin, (b) coin-selecting means operatively connected to each coin-handling means, (c) coin-selecting means operatively and selectively connected to the coin-actuating means and to each of the coin-handling means, (d) drive means operatively connected to the coin selecting means and selectively connected to the coin-actuating means for moving each coin-handling means to the first and second position, (e) the coin-actuating means including:

1. a plurality of actuating arms, each actuating arm being operatively connected to one of the coin-handling means, and
2. guide means engaging and guiding each of the actuating arms, (f) the drive means selectively engages each of the actuating arms for moving the arm and its associated coin-handling means, (g) each of the actuating arms including a guide pin, (h) the guide means including a plurality of guide slots, each guide slot receiving the guide pin of one of the actuating arms, and (i) the drive means including a drive link selectively connectible with any one of the actuating arms by the coin-selecting means, the drive means moving the drive link and the selectively connectible actuating arm for moving the associated coin-handling means.

2. A coin payout assembly as defined in claim 1, in which:

(j) the drive link is selectively alignable with any one of the guide slots by the coin-selecting means, and (k) the drive means moves the drive link into the selectively alignable guide slot and into engagement with the actuating arm having its guide pin in the guide slot for moving the associated actuating arm and coin-handling means.

3. A coin payout assembly, comprising:

(a) a plurality of coin-handling means, each coin-handling means being movable to a first position for receiving a coin and to a second position for discharging the coin, (b) coin-actuating means operatively connected to each coin-handling means, (c) coin-selecting means operatively and selectively connected to the coin-actuating means and to each of the coin-handling means, (d) drive means operatively connected to the coin-selecting means and selectively connected to the coin-actuating means for moving each coin-handling means to the first and second positions, (e) the coin-actuating means including:

1. a plurality of actuating arms, each actuating arm being operatively connected to one of the coin-handling means, and
2. guide means engaging and guiding each of the actuating arms, (f) the drive means selectively engaging each of the actuating arms for moving the arm and its associated coin-handling means, (g) each of the actuating arms including a guide pin, (h) the guide means including a plurality of guide slots, each guide slot receiving the guide pin of one of the actuating arms, (i) the drive means including a drive link selectively connectible with any one of the actuating arms by the coin-selecting means, the drive means moving the drive link and the selectively connectible actuating arm for moving the associated coin-handling means, and (j) the coin-selecting means including:

1. a crosshead mounted for movement in a predetermined path, the crosshead having a first track receiving the guide pins as the crosshead moves in the predetermined path, and a second track transverse to and communicating with the first track, the second track receiving the drive link, and 2. a crosshead-positioning means for locating the crosshead in selected positions in its predetermined path for aligning the second track with any one of the guide pins and the guide slot for the selected guide pin for movement of the guide pin in the aligned guide slot by the drive link from the first track, to move the associated arm and coin-handling means.

4. A coin payout assembly as defined in claim 3, in which:

(k) the first track provides stops adjacent the second track for engaging and precluding movement of the guide pins from the first track except for the guide pin in the guide slot aligned with the second track.

5. A coin payout assembly as defined in claim 3, in which:

(k) the crosshead-positioning means includes:

1. a cam means operatively connected to the crosshead, and 2. a solenoid operatively connected to the cam means for moving the crosshead upon energization.

6. A coin payout assembly as defined in claim 3, in which:

(k) the crosshead-positioning means includes:

1. a cam follower on the crosshead, 2. a rotatively mounted first wheel having a cam operatively engaging the cam follower for moving the crosshead, 3. a rotatively mounted second wheel, 4. a solenoid operatively connected to the second wheel for rotating the second wheel upon energization of the solenoid, and 5. means drivingly and operatively interconnecting the first and second wheels for determining the positional movement of the crosshead.

7. A coin payout assembly as defined in claim 6, in which:

(l) the first wheel includes a ratchet for retaining the first wheel and cam in predetermined rotated positions, (m) the second wheel includes a ratchet operatively connected to the solenoid, and (n) the means interconnecting the first and second wheels is gearing.

8. A coin payout assembly as defined in claim 3, in which:

(k) the drive means further includes:

1. a locating pin on the drive link and carried by the second track of the crosshead for selectively connecting the drive link with any one of the actuating arms as the second track is selectively aligned with any one of the guide slots, the drive link engaging the actuating arm that has its guide pin in the aligned guide slot for moving the associated coin-handling means to one of said positions, and 2. a shoulder on the drive link engaging the last said actuating arm for moving the associated coin-handling means to the other of said positions.

9. A coin payout assembly as defined in claim 8, in which:

(1) the drive means further includes a slidable pivot means mounting the drive link for rotative and translational movement as the drive link is rotated by the crosshead as the second track is selectively aligned with the guide slot and as the drive link engages the actuating arm having its guide pin in the aligned guide slot for moving the associated coin-handling means to said first and second positions.

10. A coin payout assembly, comprising:

(a) a plurality of coin-handling means, each coin-handling means being movable to a first position for receiving a coin and to a second position for discharging the coin, (b) coin-actuating means operatively connected to each coin-handling means, (c) coin-selecting means operatively and selectively connected to the coin-actuating means and to each of the coin-handling means, (d) drive means operatively connected to the coin-selecting means and selectively connected to the coin-actuating means for moving each coin-handling means to the first and second positions, (e) the coin-actuating means including:

1. a plurality of actuating arms, each actuating arm being operatively connected to one of the coin-handling means, and 2. guide means engaging and guiding each of the actuating arms, (f) the drive means selectively engaging each of the actuating arms for moving the arm and its associated coin-handling means, (g) each of the actuating arms including a guide pin, (h) the guide means including a plurality of guide slots, each guide slot receiving the guide pin of one of the actuating arms, (i) the drive means including a drive link selectively connectible with any one of the actuating arms by the coin-selecting means, the drive means moving the drive link and the selectively connectible actuating arm for moving the associated coin-handling means, and (j) the drive means further including:

1. a cam follower on the drive link, and 2. a cam engaging the cam follower for reciprocatively moving the drive link to move the last said associated actuating arm and coin-handling means.

11. A coin payout assembly as defined in claim 3, in which:

(k) the drive means further includes:

1. a locating pin on the drive link received in the second track of the crosshead for operatively connecting any one of the actuating arms upon selectively positioning of the crosshead, and 2. a pivot means rotatively and slidably mounting the drive link for rotative and translational movement of the drive link as the crosshead is movably positioned and as the drive link engages the actuating arm having its guide pin in the aligned guide slot for moving the associated coin-handling means.

* * * * *

UNITED STATES PATENT AND TRADEMARK OFFICE

CERTIFICATE OF CORRECTION

PATENT NO. : 4,392,505

DATED : July 12, 1983

INVENTOR(S) : Robert T. Maloney & Carl L. Vogt

It is certified that error appears in the above-identified patent and that said Letters Patent are hereby corrected as shown below:

Column 3, line 34: delete "23" and insert --3--.

Column 6, line 7 : delete "buide" and insert --guide--.

Signed and Sealed this

*Thirteenth* Day of *September 1983*

[SEAL]

*Attest:*

GERALD J. MOSSINGHOFF

*Attesting Officer*

*Commissioner of Patents and Trademarks*